US011078768B2

(12) United States Patent
Lu et al.

(10) Patent No.: US 11,078,768 B2
(45) Date of Patent: Aug. 3, 2021

(54) SUPER HEAVY OIL DEVELOPMENT METHOD FOR STRENGTHENING SAGD STEAM CHAMBER TO BREAK THROUGH LOW PHYSICAL PROPERTY RESERVOIR

(71) Applicant: CHINA UNIVERSITY OF PETROLEUM, Qingdao (CN)

(72) Inventors: Teng Lu, Qingdao (CN); Zhaomin Li, Qingdao (CN); Jianping Yang, Qingdao (CN); Hongyuan Wang, Qingdao (CN); Shizhong Wang, Qingdao (CN); Yao Wei, Qingdao (CN); Zhuangzhuang Wang, Qingdao (CN); Dawei Hou, Qingdao (CN); Yajie Xu, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 72 days.

(21) Appl. No.: 16/605,068

(22) PCT Filed: Apr. 4, 2019

(86) PCT No.: PCT/CN2019/081530
§ 371 (c)(1),
(2) Date: Oct. 14, 2019

(87) PCT Pub. No.: WO2019/218798
PCT Pub. Date: Nov. 21, 2019

(65) Prior Publication Data

US 2021/0131244 A1 May 6, 2021

(30) Foreign Application Priority Data

May 14, 2018 (CN) ..... 201810454246.4

(51) Int. Cl.
*E21B 43/24* (2006.01)
*E21B 43/30* (2006.01)
*E21B 43/16* (2006.01)

(52) U.S. Cl.
CPC ..... *E21B 43/2406* (2013.01); *E21B 43/305* (2013.01); *E21B 43/168* (2013.01)

(58) Field of Classification Search
CPC ... E21B 43/2406; E21B 43/305; E21B 43/168
See application file for complete search history.

(56) References Cited

U.S. PATENT DOCUMENTS

2005/0082067 A1* 4/2005 Good ..... E21B 43/2406 166/402
2010/0108317 A1* 5/2010 Cimolai ..... E21B 43/24 166/272.3

(Continued)

*Primary Examiner* — Crystal J Miller
(74) *Attorney, Agent, or Firm* — CBM Patent Consulting, LLC

(57) ABSTRACT

Disclosed belongs to the technical field of oil and gas field development engineering, and particularly relates to a super heavy oil development method for strengthening an SAGD steam chamber to break through a low physical property reservoir. The super heavy oil development method for strengthening the SAGD steam chamber to break through the low physical property reservoir includes the following steps: (1) selection of a developed oil reservoir; (2) well distribution; (3) steam chamber forming; (4) steam chamber expansion; (5) steam chamber strengthening. The method may enhance the ability of the steam chamber to break through the low physical property reservoir, enlarge the development height of the steam chamber, and further improve the SAGD development effect of super heavy oil.

4 Claims, 2 Drawing Sheets

(56) References Cited

U.S. PATENT DOCUMENTS

| | | | | |
|---|---|---|---|---|
| 2014/0124194 | A1* | 5/2014 | Jorshari | E21B 43/24 166/245 |
| 2015/0285051 | A1* | 10/2015 | Miller | E21B 43/2408 166/272.3 |
| 2015/0345270 | A1* | 12/2015 | Elliott | E21B 43/20 166/272.3 |

* cited by examiner

SUPER HEAVY OIL DEVELOPMENT METHOD FOR STRENGTHENING SAGD STEAM CHAMBER TO BREAK THROUGH LOW PHYSICAL PROPERTY RESERVOIR

FIELD OF THE INVENTION

The present disclosure belongs to the technical field of oil and gas field development engineering, and particularly relates to a super heavy oil development method for strengthening an SAGD steam chamber to break through a low physical property reservoir.

BACKGROUND OF THE INVENTION

Steam assisted gravity drainage (SAGD) is a heavy oil thermal recovery technology developed by combining fluid thermal convection with heat conduction, taking steam as a heating medium and relying on the gravity of crude oil. Therefore, the expansion and development of a steam chamber in an SAGD process has an important effect on the development of SAGD. A low physical property reservoir refers to a relatively low permeability layer distributed in a unit sandstone layer, which is distributed without interval, and is stable, small in area and short in extension; the low physical property reservoir is mostly located in the sand layer, with a thickness of several tens of centimeters to several meters, which cannot obviously prevent or control the movement of fluid. However, it can affect the distribution of oil and water in a local area, which has obvious influence on the steam chamber development and the production effect in the SAGD development process.

Super heavy oil cannot flow under an original oil reservoir condition, and an interwell oil layer is preheated through a shaft steam circulation or steam huff and puff method of an upper horizontal well and a lower horizontal well. After the thermal communication is formed between the injection and production wells, the upper horizontal well continuously injects steam, which forms a steam chamber to be expanded to the upper part of the oil layer, and the lower horizontal well continuously produces. When the steam chamber reaches the low physical property reservoir, the steam is condensed to form hot water, so that the steam chamber cannot break through the low physical property reservoir and cannot be continuously expanded upwards, and the oil production speed is rapidly reduced. It can be seen that the low physical property reservoir can inhibit the rising of the steam chamber, which causes a well group to enter a horizontal expansion stage of the steam chamber in advance, so that the heat energy consumption is large, and the output and the oil-steam ratio are reduced.

A conventional SAGD development technology requires that there is no continuous distribution of low physical reservoirs in the oil layer, but in Xinjiang, Liaohe and other SAGD development blocks, there are continuously distributed low physical reservoirs in the oil layer, which leads to that the SAGD steam chamber in these blocks cannot be continuously expanded after encountering the low physical reservoir, thus influencing the development effect.

SUMMARY OF THE INVENTION

The present disclosure aims to provide a super heavy oil development method for strengthening an SAGD steam chamber to break through a low physical property reservoir, aiming at the problems that the low physical property reservoir may inhibit the rise of the steam chamber, so that the steam chamber may not break through the low physical property reservoir to be continuously expanded upwards, the development height of the steam chamber is restricted, and the development effect is further influenced. The method may enhance the ability of the steam chamber to break through the low physical property reservoir, enlarge the development height of the steam chamber, and further improve the SAGD development effect of super heavy oil.

The technical scheme of the present disclosure is as follows: a super heavy oil development method for strengthening an SAGD steam chamber to break through a low physical property reservoir includes the following steps:

(1) selection of a developed oil reservoir: according to the geological characteristics and the development status of an oil reservoir, roughly screening the oil reservoir applicable to the development method according to the following conditions: an oil layer is a middle-deep oil reservoir, the buried depth is less than 1000 m, the remaining oil saturation is greater than 0.5, the thickness of the oil layer is greater than 20 m, the horizontal permeability is greater than 1000 mD, a ratio of vertical permeability to horizontal permeability is greater than 0.35, the porosity of the oil layer is greater than 0.20, a continuously or discontinuously developed low physical property reservoir exists in the oil layer, and the permeability of the low physical property reservoir is greater than 100 mD;

(2) well distribution: drilling two vertically opposite horizontal wells in the oil layer, wherein the horizontal well at the upper part is a steam injection well, the horizontal well at the lower part is a production well, the horizontal well at the lower part is 3-5 m away from the bottom of the oil layer, and the vertical distance between the two horizontal wells is 4-6 m;

(3) steam chamber forming: forming, by the steam injection well and the production well, thermal communication in a steam huff and puff or steam injection circulation preheating mode, and after forming the thermal communication, continuously injecting, by the steam injection well, high-dryness steam, wherein the steam dryness is greater than 70%, the injected steam develops to the upper part of the oil layer to form a steam chamber, and the production well continuously produces;

(4) steam chamber expansion: continuously expanding the steam chamber formed in step (3), and when the steam chamber is expanded to reach the low physical property reservoir, condensing steam to form hot water, so that the steam chamber may not break through the low physical property reservoir and may not be continuously expanded upwards, and the oil production speed is rapidly reduced, wherein the time to reach the low physical property reservoir is determined according to the distance between the steam injection well and the low physical property reservoir and the steam injection speed; and (5) steam chamber strengthening: strengthening the steam chamber by injecting gas into the steam injection well, so that the steam chamber breaks through the low physical property reservoir and is continuously expanded upwards.

The gas in step (5) is nitrogen, carbon dioxide or flue gas from a steam injection boiler.

The gas is injected into the steam injection well in step (5) by injecting gas and steam into the steam injection well simultaneously.

The step of simultaneously injecting gas and steam into the steam injection well is as follows: a gas slug and a steam slug are simultaneously injected into a steam injection well, during the injection process, a ratio of a gas injection speed ($m^3/d$) to a steam injection speed ($m^3/d$) is less than 0.1 and a gas injection amount is less than 0.01 PV under an oil layer condition, the steam is continuously injected after the gas injection is completed, if an oil production speed is gradually increased, the steam chamber is obviously expanded, it indicates that the injected gas strengthens the expansion of the steam chamber and breaks through the low physical property reservoir, no gas is injected, and steam is continuously injected; and if the oil production speed and the expansion condition of the steam chamber are not improved, that is, the oil production speed is not increased and the steam chamber is not obviously expanded, a gas slug and a steam slug are simultaneously injected into a steam injection well again, a ratio of a gas injection speed ($m^3/d$) to a steam injection speed ($m^3/d$) is less than 0.1 and a gas injection amount is less than 0.01 PV under an oil layer condition, steam is continuously injected after the gas injection is completed, and the oil production speed and the expansion condition of the steam chamber are observed.

The gas is injected into the steam injection well in step (5) by injecting gas and steam into the steam injection well alternately.

The step of injecting gas and steam into the steam injection well alternately is as follows: a gas slug is injected firstly, the gas injection amount is less than 0.01 PV, a steam slug is then injected, a volume ratio of the gas slug to the steam slug is less than 0.1 under the oil layer condition, the oil production speed of firstly injecting the gas slug and then injecting the steam slug and the expansion condition of the steam chamber are observed, if the oil production speed is gradually increased, the steam chamber is obviously expanded, it indicates that the injected gas strengthens the expansion of the steam chamber and breaks through the low physical property reservoir, no gas is injected, and steam is continuously injected; and if the oil production speed and the expansion condition of the steam chamber are not improved, that is, the oil production speed is not increased and the steam chamber is not obviously expanded, a gas slug and a steam slug are again injected into the steam injection well alternately, the gas slug is injected firstly, the gas injection amount is less than 0.01 PV, the steam slug is then injected, a volume ratio of the gas slug to the steam slug is less than 0.1 under the oil layer condition, and the oil production speed of firstly injecting the gas slug and then injecting the steam slug and the expansion condition of the steam chamber are observed.

The present disclosure has the beneficial effects that: according to the super heavy oil development method for strengthening the SAGD steam chamber to break through the low physical property reservoir, gas strengthens the SAGD steam chamber to break through the development of the low physical property reservoir, the non-condensation property of the gas is utilized, the gas state is maintained, and the gas may break through the low physical property reservoir to form a gas channeling channel, so that the flow of the steam is facilitated. In addition, the gas thermal conductivity coefficient is small, the steam may be prevented from being rapidly condensed in the low physical property reservoir to form hot water, and the steam state is kept. The two factors make the gas strengthen the steam chamber to break through the low physical property reservoir and improve the effect of SAGD development.

In summary, the method may enhance the ability of the steam chamber to break through the low physical property reservoir, enlarge the development height of the steam chamber, and further improve the SAGD development effect of super heavy oil.

DETAILED DESCRIPTION OF THE EMBODIMENTS

Figure 1:
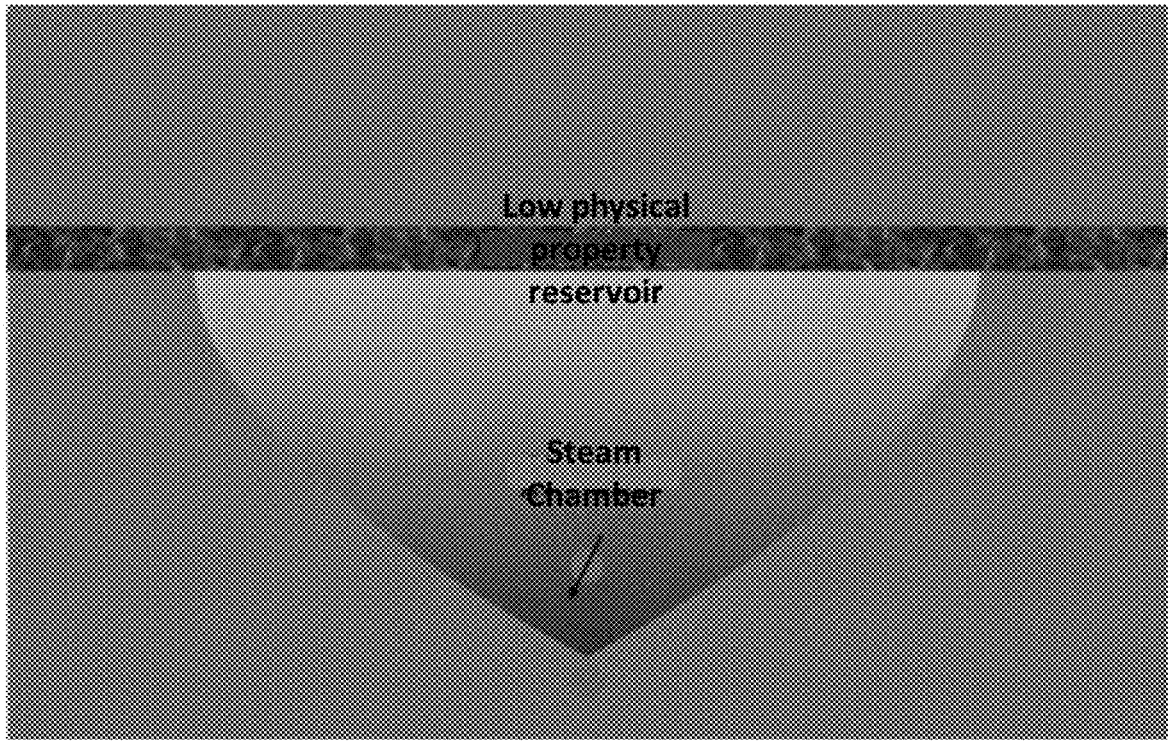
FIG. 1 is a schematic view showing that a steam chamber cannot break through a low physical property reservoir to be continuously expanded upwards.
Figure 2:
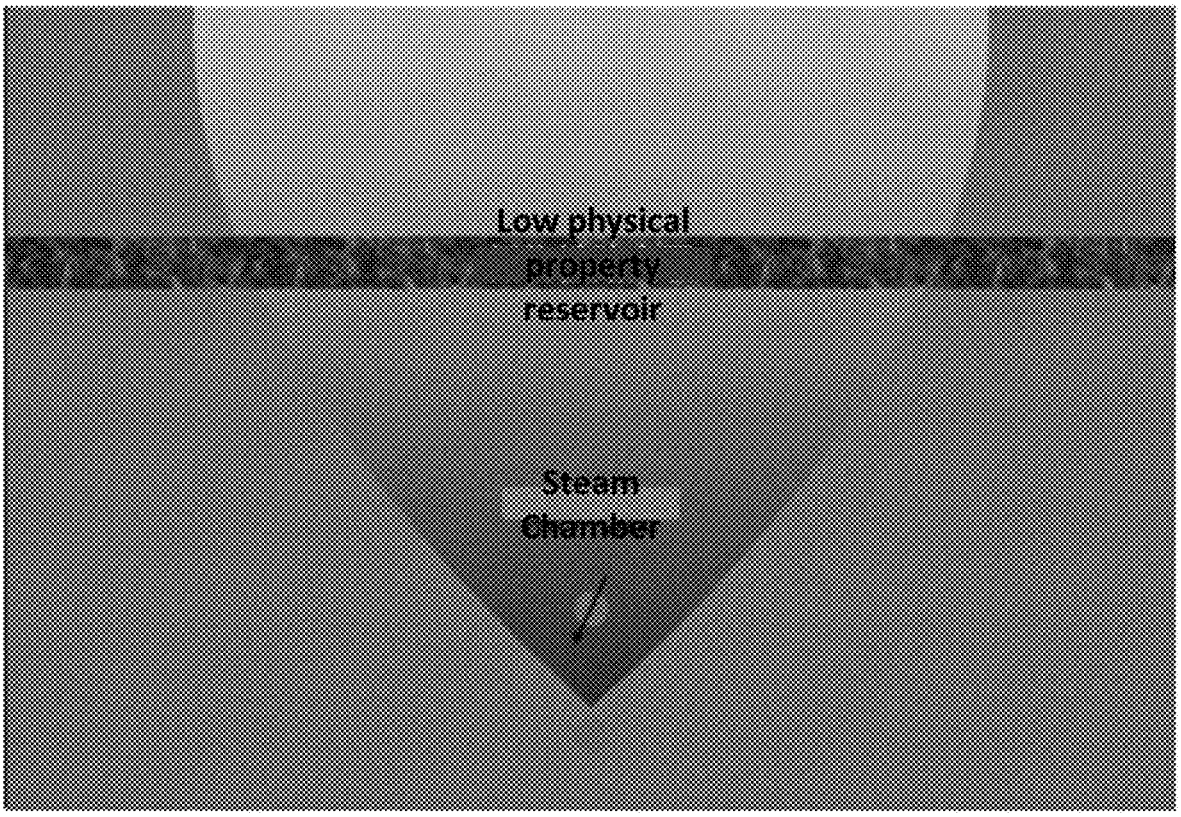
FIG. 2 is a schematic view showing that gas strengthens an SAGD steam chamber to break through a low physical property reservoir to be continuously expanded upwards according to the present disclosure.

The present disclosure will now be described in detail, by way of example and not limitation, with reference to the accompanying drawings.

Embodiment 1

A super heavy oil development method for strengthening an SAGD steam chamber to break through a low physical property reservoir includes the following steps:

(1) Selection of a developed oil reservoir: An oil reservoir of an oil field 1 has a buried depth of 480 m, an oil layer thickness of 35 m, a net total thickness ratio of 0.86, an average porosity of 35.7%, an average horizontal permeability of 3880 mD, a ratio of vertical permeability to horizontal permeability of 0.5, and an initial oil saturation of 0.75, a continuously distributed low physical reservoir is developed in the oil layer, and has an average thickness of 0.05 m and a permeability of 105 mD, the viscosity of crude oil is $21.5\times10^4$ mPa·s under an oil layer condition, and an initial pressure of the oil reservoir is 4.2 MPa.

The oil reservoir meets the following conditions: the buried depth of the oil reservoir is less than 1000 m, the oil saturation is greater than 0.5, the thickness of the oil layer is greater than 20 m, the horizontal permeability is greater than 1000 mD, a ratio of vertical permeability to horizontal permeability is greater than 0.35, the porosity of the oil layer is greater than 0.20, a continuously developed low physical property reservoir exists in the oil layer, and the permeability of the low physical property reservoir is greater than 100 mD.

(2) Well distribution: Two horizontal wells are newly drilled in the oil layer, the positions of the two horizontal wells are vertically aligned, the lower horizontal well serves as a production well and is 3 m away from the bottom of the oil layer, and the upper horizontal well serves as a steam injection well and is 7 m away from the bottom of the oil layer.

(3) Steam chamber forming: The two horizontal wells preheat the oil layer in a shaft steam circulation mode for 3 months, and after thermal communication is formed between the two horizontal wells, high-dryness steam is continuously injected into the steam injection well, where the dryness of the steam is greater than 70%, the injected steam develops to the upper part of the oil layer to form a steam chamber, and the production well performs oil extraction continuous production.

(4) Steam chamber expansion: The steam chamber formed in step (3) is continuously expanded, after one year of production, the steam chamber is expanded to the low physical property reservoir, and the steam is condensed to form hot water, so that the steam chamber may not break through the low physical property reservoir and may not be continuously expanded upwards, and the oil yield of the production well is rapidly reduced.

(5) Steam chamber strengthening: At this time, gas starts to strengthen an SAGD steam chamber to break through the development of the low physical property reservoir, a nitrogen slug is injected into the steam injection well with a nitrogen injection amount of 0.005 PV, then a steam slug is injected with a steam slug injection amount of 0.6 PV, it is found by steam injection that the oil production speed is not improved significantly, at this time, a second nitrogen slug is injected with an injection amount of 0.005 PV, then a steam slug is again injected with a steam slug injection amount of 0.6 PV, it is found that the oil production speed is improved significantly, and the development of the steam chamber is obviously improved, which indicates that the injected nitrogen strengthens the expansion of the steam chamber and improves the SAGD development effect.

The super heavy oil development method for strengthening the SAGD steam chamber by nitrogen to break through the low physical property reservoir is implemented in the block. The average daily oil production of four horizontal wells increases from 252 t/d to 395 t/d, and the average oil/steam ratio increases from 0.23 to 0.33, which increases by 43%. After the implementation, the steam chamber is continuously expanded in the longitudinal direction and rises by 25 m in the longitudinal direction.

What is claimed is:

1. A super heavy oil development method for strengthening an SAGD steam chamber to break through a low physical property reservoir, comprising the following steps:

(1) selection of a developed oil reservoir: according to geological characteristics and development status of an oil reservoir, roughly screening the oil reservoir applicable to development method according to the following conditions: an oil layer is a middle-deep oil reservoir, a buried depth is less than 1000 m, the remaining oil saturation is greater than 0.5, the thickness of the oil layer is greater than 20 m, the horizontal permeability is greater than 1000 mD, a ratio of vertical permeability to horizontal permeability is greater than 0.35, the porosity of the oil layer is greater than 0.20, a continuously or discontinuously developed low physical property reservoir exists in the oil layer, and the permeability of the low physical property reservoir is greater than 100 mD;

(2) well distribution: drilling two vertically opposite horizontal wells in the oil layer, wherein the horizontal well at an upper part is a steam injection well, the horizontal well at a lower part is a production well, the horizontal well at the lower part is 3-5 m away from the bottom of the oil layer, and the vertical distance between the two horizontal wells is 4-6 m;

(3) steam chamber forming: forming, by the steam injection well and the production well, thermal communication in a steam huff and puff or steam injection circulation preheating mode, and after forming the thermal communication, continuously injecting, by the steam injection well, high-dryness steam, wherein the steam dryness is greater than 70%, the injected steam develops to the upper part of the oil layer to form a steam chamber, and the production well continuously produces;

(4) steam chamber expansion: continuously expanding the steam chamber formed in step (3), and when the steam chamber is expanded to reach the low physical property reservoir, condensing steam to form hot water, so that the steam chamber may not break through the low physical property reservoir and may not be continuously expanded upwards; and (5) steam chamber strengthening: strengthening the steam chamber by injecting gas into the steam injection well, so that the steam chamber breaks through the low physical property reservoir and is continuously expanded upwards; wherein the gas is injected into the steam injection well by injecting gas and steam into the steam injection well simultaneously as follows: a gas slug and a steam slug are simultaneously injected into a steam injection well, during the injection process, a ratio of a gas injection speed to a steam injection speed is less than 0.1 and a gas injection amount is less than 0.01 PV under an oil layer condition, the steam is continuously injected after the gas injection is completed, if an oil production speed is increased, the steam chamber is expanded, it indicates that the injected gas strengthens the expansion of the steam chamber and breaks through the low physical property reservoir, no gas is injected, and steam is continuously injected; and if the oil production speed and the expansion condition of the steam chamber are not improved, that is, the oil production speed is not increased and the steam chamber is not expanded, the gas slug and the steam slug are simultaneously injected into the steam injection well again, a ratio of a gas injection speed to a steam injection speed is less than 0.1 and a gas injection amount is less than 0.01 PV under an oil layer condition, steam is continuously injected after the gas injection is completed, and the oil production speed and the expansion condition of the steam chamber are observed.

2. The super heavy oil development method for strengthening the SAGD steam chamber to break through the low physical property reservoir according to claim 1, wherein the gas in step (5) is nitrogen, carbon dioxide or flue gas from a steam injection boiler.

3. The super heavy oil development method for strengthening the SAGD steam chamber to break through the low physical property reservoir according to claim 1, wherein the gas is injected into the steam injection well in step (5) by injecting gas and steam into the steam injection well alternately.

4. The super heavy oil development method for strengthening the SAGD steam chamber to break through the low physical property reservoir according to claim 3, wherein the step of injecting gas and steam into the steam injection well alternately is as follows: a gas slug is injected firstly, the gas injection amount is less than 0.01 PV, a steam slug is then injected, a volume ratio of the gas slug to the steam slug is less than 0.1 under the oil layer condition, the oil production speed of firstly injecting the gas slug and then injecting the steam slug and the expansion condition of the steam chamber are observed, if the oil production speed is increased, the steam chamber is expanded, it indicates that the injected gas strengthens the expansion of the steam chamber and breaks through the low physical property reservoir, no gas is injected, and steam is continuously injected; and if the oil production speed and the expansion condition of the steam chamber are not improved, a gas slug and a steam slug are again injected into the steam injection well alternately, the gas slug is injected firstly, the gas injection amount is less than 0.01 PV, the steam slug is then injected, a volume ratio of the gas slug to the steam slug is less than 0.1 under the oil layer condition, and the oil production speed of firstly injecting the gas slug and then injecting the steam slug and the expansion condition of the steam chamber are observed.

* * * * *